US005561872A

United States Patent [19]

Phillips

[11] Patent Number: 5,561,872

[45] Date of Patent: Oct. 8, 1996

[54] APPARATUS FOR RAISING AND LOWERING A SEAT

[76] Inventor: Barry S. Phillips, 8062 College Corner Rd., Centerville, Ind. 47330

[21] Appl. No.: 342,622

[22] Filed: Nov. 21, 1994

[51] Int. Cl.[6] ..... A47K 13/10

[52] U.S. Cl. ..... 4/667; 4/254

[58] Field of Search ..... 4/254, 667; 297/DIG. 10

[56] References Cited

U.S. PATENT DOCUMENTS

| | | | |
|---|---|---|---|
| 3,925,833 | 12/1975 | Hunter . | |
| 4,168,552 | 9/1979 | Austin | 4/667 |
| 4,587,678 | 5/1986 | Love et al. . | |
| 4,993,085 | 2/1991 | Gibbons | 4/667 |
| 5,094,508 | 3/1992 | Bathrick et al. | 297/DIG. 10 X |
| 5,309,583 | 5/1994 | White et al. | 21/667 |

*Primary Examiner*—Charles E. Phillips
*Attorney, Agent, or Firm*—Jacox, Meckstroth & Jenkins

[57] ABSTRACT

A frame of square tubular metal includes a U-shaped base and a pair of parallel spaced support members projecting upwardly from the base at an inclined angle for supporting a pair of telescopic arms. A seat extends between the arms and is supported by a pair of brackets adjustably clamped to the arms. Each arm is connected to a corresponding reversible motor driven screw jack which extends vertically under the arm to the base, and the motors are electrically connected for simultaneous operation to move the arms and seat member between an upper elevated position and a lower retracted position. The seat may be removed by lifting the seat from the brackets which also support the seat for automatic tilting. The seat may be a toilet seat with side wings or may be a seat connected to a back support panel.

14 Claims, 2 Drawing Sheets

APPARATUS FOR RAISING AND LOWERING A SEAT

BACKGROUND OF THE INVENTION

In the art of power assisted devices or apparatus for moving a toilet seat between an upper elevated position and a lower retracted position to assist a handicapped person, hydraulically operated lift devices have been used or proposed, for example, as disclosed in U.S. Pat. No. 3,925,833 and No. 4,993,085. These lift devices may incorporate a self-contained hydraulic lift system, as disclosed in the '833 patent, or may use the pressurized water supplied to the toilet, as disclosed in the '085 patent. The pressurized water actuating system is undesirable since it requires installation or connection to the water supply line, and the self-contained hydraulic actuating system involves numerous components which contribute to a significantly higher manufacturing cost and increased maintenance. In addition, both systems are not portable and can present a problem of fluid Or water leakage onto the floor.

It is also known to employ one or more screw jacks for lifting or tilting a toilet seat to assist a handicapped person, for example, as disclosed in U.S. Pat. No. 4,168,552 and No. 4,587,678. The '552 patent discloses a toilet seat supported by two vertical screw jacks, and an electric motor is connected by a belt and pulley system to drive parallel shafts extending rearwardly from the screw jacks. This lift system is permanently installed under a toilet and is anchored to the floor. The '678 patent discloses the use of a single motor operated screw jack for tilting a toilet seat which is pivotally supported above the toilet bowl at a higher elevation.

SUMMARY OF THE INVENTION

The present invention is directed to an improved power operated device or apparatus for raising and lowering a seat and which is ideally suited for use with a toilet without requiring any modification of the toilet or connection to a water supply line. The device is also adapted to be used for raising and lowering other forms of seats for assisting a handicapped person. The apparatus of the invention is portable and convenient to use and may be quickly adjusted to accommodate toilets of different heights. In addition, the apparatus provides a seat which automatically tilts when a person supported by the seat is moving between a standing position and a seated position, and the seat is easily removed to provide for convenient cleaning or interchanging with other seats.

In accordance with one embodiment of the invention, a device or apparatus for raising and lowering a seat includes a light weight frame formed of square metal tubing and having generally a U-shaped horizontal base which supports a pair of upwardly and forwardly projecting support members. A pair of parallel spaced angular arms receive the support members in telescopic relation, and a seat member extends between the arms. A pair of adjustable brackets are clamped to the arms and have inclined upper surfaces surrounding corresponding slots which receive pins projecting downwardly from opposite sides of the seat member. The slots and pins permit the seat member to tilt with a person supported by the seat and also permit the seat to be simply lifted from the support brackets for cleaning the seat and toilet or for installing another form of seat.

A reversible motor driven screw jack extends vertically under each of the arms and connects the arm to the base. The motors are electrically connected and controlled by a switch on one of the arms to provide for simultaneous operation of the screw jacks for moving the seat between a generally horizontal lower position and a tilted upper position for assisting the movement of a person between standing and seated positions.

Other features and advantages of the invention will be apparent from the following description, the accompanying drawings and the appended claims.

DESCRIPTION OF THE PREFERRED EMBODIMENTS

Figure 1:
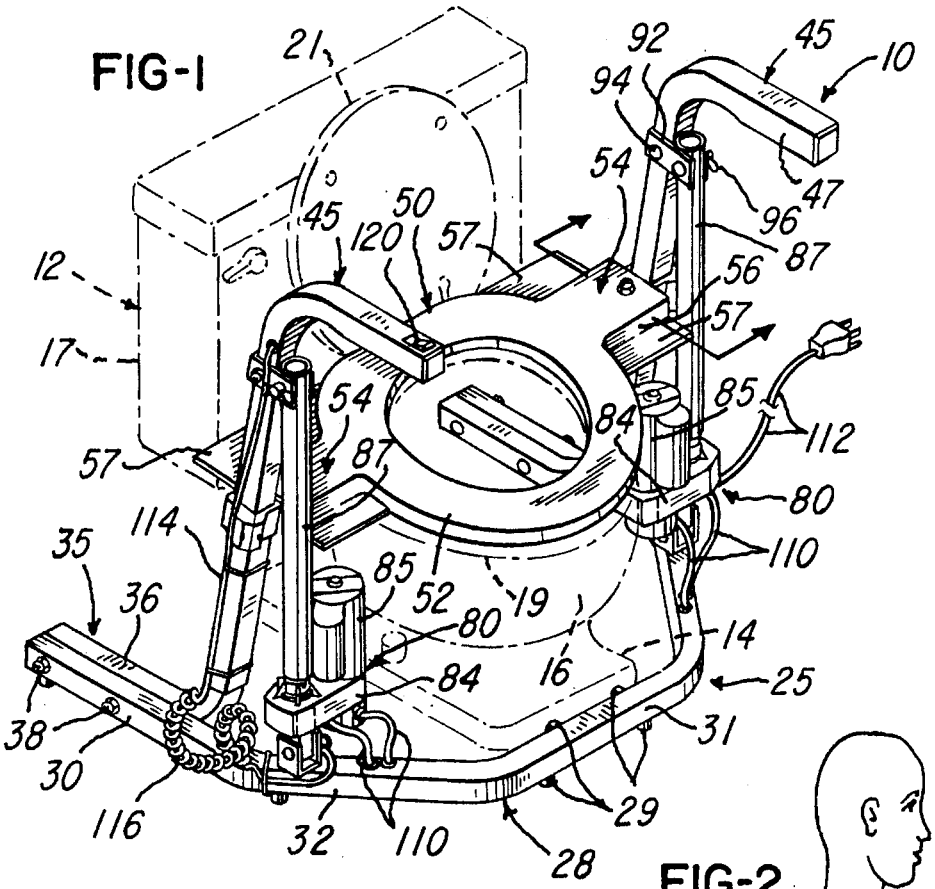
FIG. 1 is a perspective view of seat lifting or elevating apparatus constructed in accordance with the invention and showing the apparatus positioned for use with a toilet shown in phantom and with the seat of the apparatus in its lower retracted position.

FIG. 1 illustrates a portable lift device 10 which is adapted for use with a conventional water closet or toilet 12 (FIGS. 1 and 2) having a base 14 with a bowl portion 16 and supporting a water storage tank 17. The toilet 12 is also provided with a conventional toilet seat 19 which is pivotally supported along with a toilet seat cover 21. As will be apparent, the lift device 10 is ideally suited for use with a toilet 12, but may also be used for raising and lowering another form of seat used for assisting a handicapped person.

In accordance with the invention, the lift device 10 includes a frame 25 which is formed from tubular steel or aluminum having a generally rectangular or square cross-sectional configuration. The frame 25 includes a U-shaped base 28 which carries resilient pads 29 adapted to rest on a floor surface and has parallel spaced leg members 30 connected by a front cross member 31 and angular corner members 32. The frame 25 also includes a pair of parallel spaced L-shaped support members 35 (FIG. 2) which have lower horizontal portions 36 extending parallel to the leg members 30 of the base 28 and are rigidly secured to the leg members 30 by a set of bolts 38. The support members 35 also include a pair of parallel spaced support portions 41 which project upwardly from the base 28 and are inclined forwardly by approximately 10 degrees.

Figure 2:
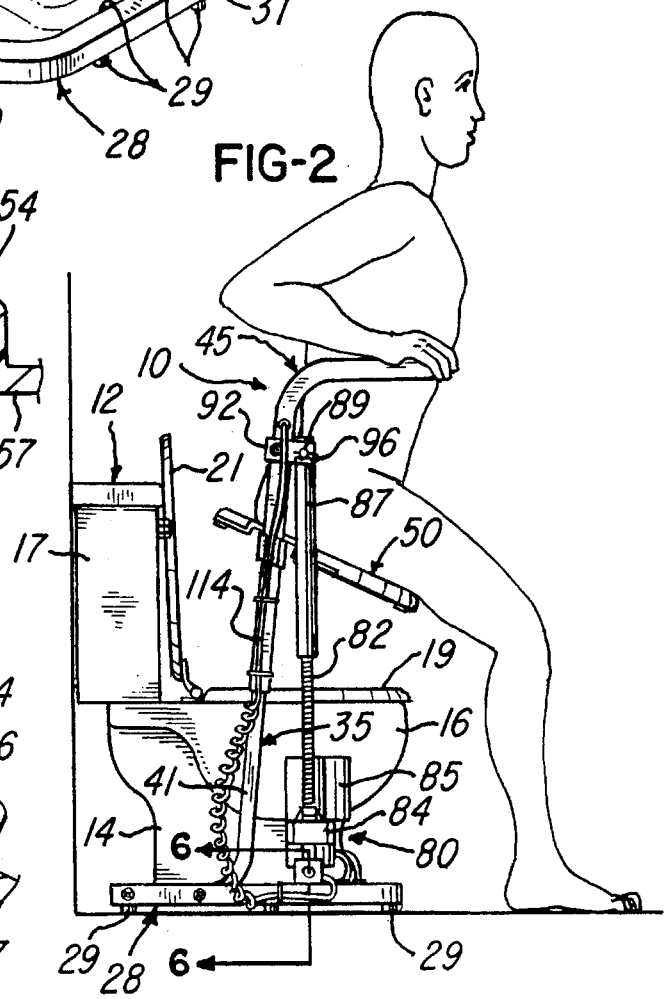
FIG. 2 is a side elevational view of the apparatus in an upper elevated position with a person supported by the seat in a tilted position.

Each of the support members 35 supports an inverted L-shaped arm 45 for telescopic movement between a retracted lower position (FIG. 1) and an extended elevated or upper position (FIG. 2). Each of the arms 45 is also constructed of generally rectangular or square metal tubing and includes a horizontal handle portion 47 which projects forwardly relative to the front of the frame 25 formed by the cross member 31 of the base 28.

A seat member 50 is constructed by vacuum forming or molding a rigid plastics material and includes an annular portion 52 and integrally molded wings 54 which project laterally from opposite sides of the annular portion 52. The wings 54 are located slightly to the rear of the annular portion 52 and each of the wings 54 includes a channel port ion 56 and a pair of forwardly and rearwardly projecting flange portions 57 to provide the seat 50 with substantial rigidity.

As shown in FIG. 1, the side wings 54 of the seat 50 project to the opposing inner surfaces of the arms 45, and a locating pin 61 (FIG. 3) is threadably connected to each channel portion 56 of the seat 50 and is secured by a nut 62. Each of the pins 61 projects downwardly from the corresponding wing 54 into a slot 63 formed within a projection 64 of a support bracket 65 mounted on the corresponding arm 45.

Figure 5:
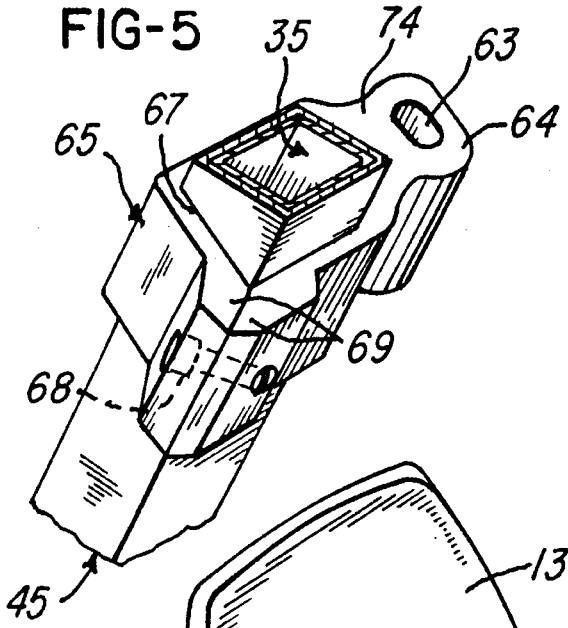
FIG. 5 is an enlarged fragmentary perspective view of an adjustable seat support bracket mounted on an arm.

Referring to FIG. 5, each of the brackets 65 defines a generally rectangular opening 67 for receiving the corresponding arm 45, and the bracket 65 is clamped to the arm by a set screw 68 extending through outwardly projecting corner portions 69 of the bracket. The corner portions 69 are disconnected to form a split clamp-type bracket so that when the screw 68 is released, the bracket may be adjusted generally vertically on a corresponding arm 45. Each of the brackets 65 has an inclined or sloping upper surface 74 which projects at an angle of about 10 degrees relative to a plane perpendicular or normal to the arm 45.

Figure 3:
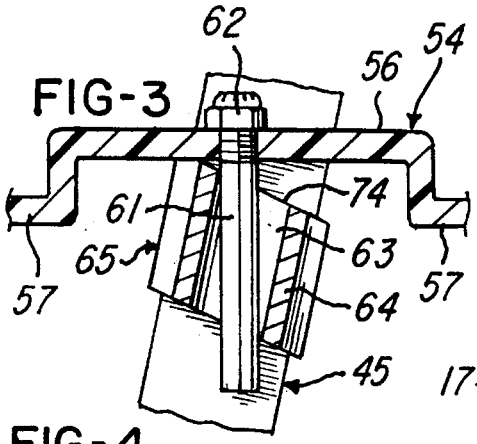
FIG. 3 is an enlarged fragmentary section of a seat support, as taken generally on the line 3—3 of FIG. 1.
Figure 4:
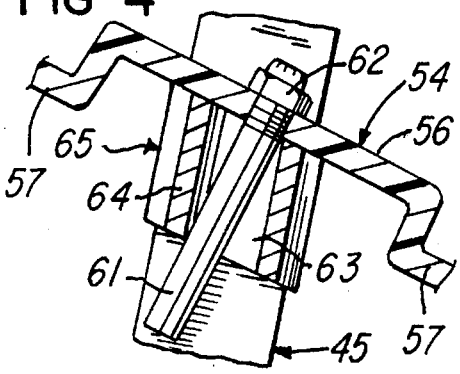
FIG. 4 is a fragmentary section similar to FIG. 3 and showing the seat supported in the tilted position of FIG. 2.

As shown in FIGS. 3 and 4, the brackets 65 support the seat 50 for tilting movement between a horizontal position (FIG. 3) and a downwardly sloping position (FIG. 4). A plane defined by the axes of the pins 61 extends through the center portion of the seat 50 slightly to the rear of the center axes of the annular portion 52.

A motor driven screw jack unit 80 extends generally vertically under each arm 45 (FIG. 1) to the corresponding base portion 28, and each unit 80 includes a substantially vertical screw 82 (FIG. 2) projecting upwardly from a gear reducer 84 driven by a reversible electric motor 85. The screw 82 of each unit 80 receives a nut (not shown) which is confined within the lower end portion of a tubular sleeve 87. The upper end portion of each sleeve 87 is pivotally connected by cross pin 89 to a U-shaped bracket 92 secured to the corresponding arm 45 by a cross bolt 94. A wire retaining clip 96 (FIG. 2) retains the cross pin 89.

Figure 6:
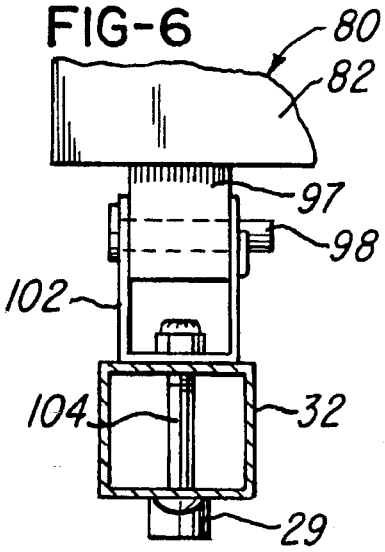
FIG. 6 is an enlarged fragmentary section taken generally on the line 6—6 of FIG. 2.

Referring to FIG. 6, a lug or block 97 projects downwardly from the gear reducer 84 of each screw jack unit 80 and is pivotally connected by a cross pin 98 to a U-shaped bracket 102 secured to the upper surface of the tubular base portion 32 by a bolt 104. One screw jack unit 80 which has provided satisfactory results in a prototype lift device 10 is manufactured and sold by Hubbell Special Products in Kenosha, Wis.

The motors 85 are electrically connected for simultaneous operation by a wiring harness or conductors 110 which extend through the forward portions 31 and 32 of the tubular base 28, and a power supply cord 112 extends from one of the units 82 to a conventional 110 volt power supply. The motors 85 are controlled through a conductor 114 which includes an extendable helical coil portion 116 and extends upwardly through one of the handle portions 47 to a rocker-type control switch 120 recessed within the handle portion. When the control switch 120 is actuated in one direction, the screw jacks 80 extend upwardly to raise the arms 45 and seat 50 to an upper elevated position, as shown in FIG. 2. When the switch 120 is actuated in the opposite direction, the motors 85 reverse, and the jacks 80 operate to lower the arms 45 and seat 50 to a retracted lower seating position, shown in FIG. 1. As shown in FIG. 2, when a person is seated on the seat 50 and is being moved between a lower seated position and an upper standing position, the seat 50 is free to tilt on the support brackets 65 between a horizontal seating position (FIG. 3) and an inclined elevated position (FIG. 2). This tilting permits the entire seat 50 to remain in natural contact with the person as the body changes between a seated position and a standing position.

Figure 7:
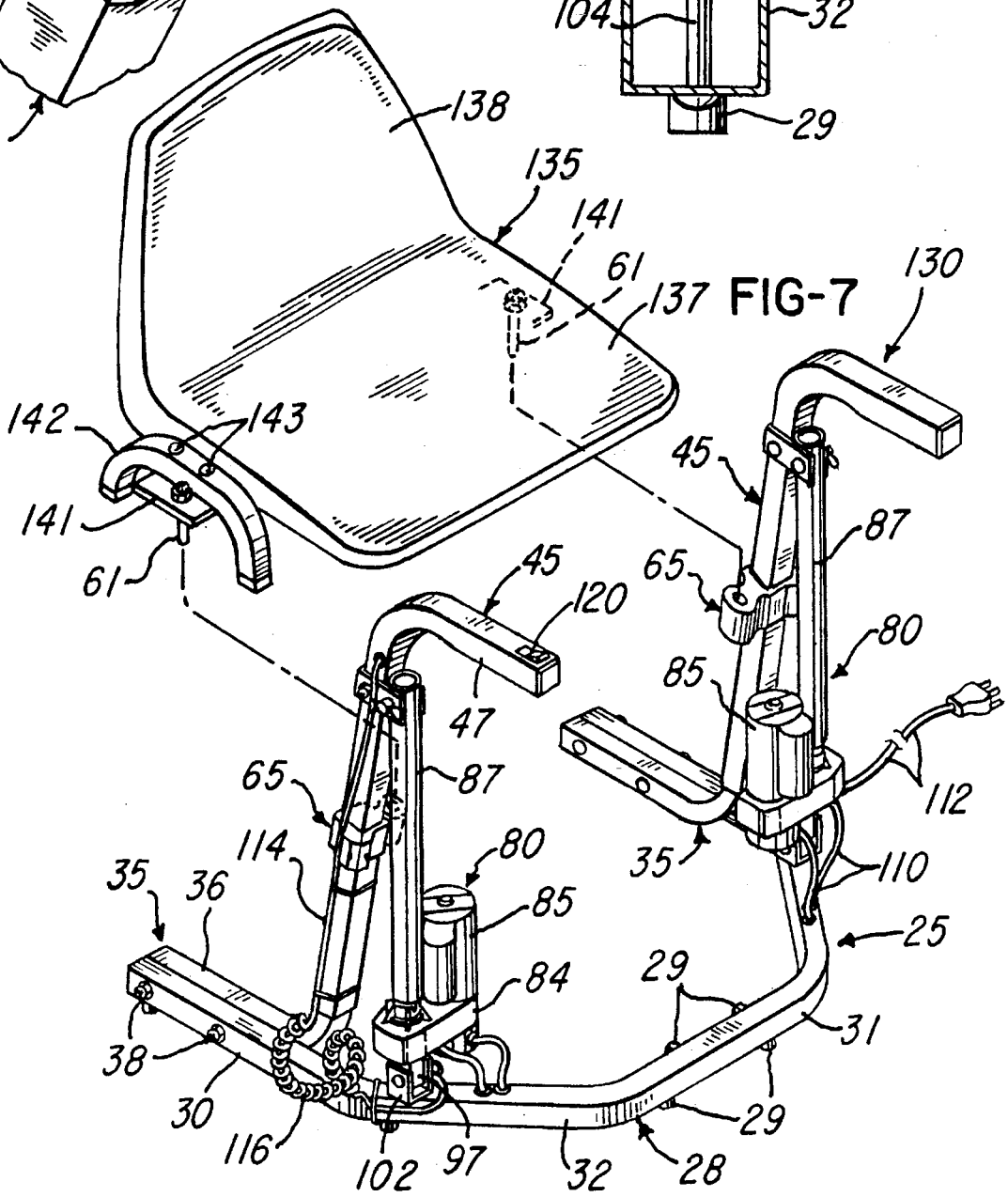
FIG. 7 is a perspective view of the lifting mechanism shown in FIG. 1 and with a different form of seat exploded from the mechanism.

Referring to FIG. 7, a lift device 130 is constructed the same as the lift device 10 but with another seat 135. The seat 135 is molded of a rigid plastics material and includes a generally horizontal portion 137 integrally connected to a back rest portion 138. A plate 141 is secured to each side portion of the seat 135 and projects laterally outwardly to receive a downwardly projecting pin 61. An inverted U-shaped leg member 142 is secured to each plate 141 by a pair of bolts 143, and the bottom ends of the leg members 142 define a plane located below the bottom ends of the pin 61 so that the leg members 142 may rest upon a bench or floor surface when the seat 135 is used without the lift mechanism.

As apparent from FIGS. 3, 4 and 7, when it is desired to remove the seat 50 to provide for conventional use or cleaning of the toilet 12, the seat 50 is simply lifted upwardly to retract the pins 61 from the corresponding slots 63 within the support brackets 65. Thus the seat 50 may be conveniently removed and replaced with the seat 135 in the event it is desirable to use the lifting apparatus or device 10 or 130 for raising and lowering another form of seat such as the seat 135.

From the drawings and the above description, it is apparent that a seat lifting device constructed in accordance with the invention, provides desirable features and advantages. For example, the device 10 may be conveniently transported and easily placed in front of a conventional toilet 12, with the screw jacks 80 positioned laterally outwardly of the toilet 12 so that they do not interfere with convenient use of the toilet. In addition, the easily removable seat 50 or 135 is desirable for conveniently transporting the lifting device or for interchanging different types of seats depending upon the desired use of the lifting device.

The support brackets 65 also permit automatic tilting of the seat during movement of a person between standing and seated positions so that the seat is naturally comfortable and helps push the body upwardly and forwardly to a body balanced position as the seat is raised to its elevated position where the seat is tilted at approximately twenty degrees with respect to horizontal. The location of the pins 61 slightly behind the center of the seat also provides for proper balance of the person and assists the automatic tilting. The adjustable clamps 65 further provide for precisely positioning the seat 50 in its lower retracted position so that it rests on the toilet seat 19 or bowl 16 of the toilet 12.

While the forms of seat lifting apparatus herein described constitute preferred embodiments of the invention, it is to be understood that the invention is not limited to these precise forms of apparatus, and that changes may be made therein without departing from the scope and spirit of the invention as defined in the appended claims.

The invention having thus been described, the following is claimed:

1. Apparatus for raising and lowering a seat member to assist a handicapped person, comprising a frame including a base adapted to rest on a floor and having generally parallel tubular leg members connected by a tubular front cross member, a pair of elongated parallel spaced and inclined tubular support members projecting upwardly and forwardly from said base, a pair of tubular seat carrier members mounted on corresponding said support members for telescopic movement, said seat member extending between said seat carrier members, a set of support brackets clamped to said seat carrier members and supporting said seat member for movement with said seat carrier members, a pair of generally vertical lift units spaced in front of the corresponding said inclined support members and connecting said base to the corresponding said seat carrier members, and said lift units cooperate to move said seat carrier members and said seat member along said support members between an upper elevated position and a lower seating position.

2. Apparatus as defined in claim 1 wherein said support brackets releasably clamp the corresponding said seat carrier members, and said support brackets are adjustable generally vertically on said seat carrier members when said brackets are released for vertically adjusting said seat member at said lower seating position.

3. Apparatus as defined in claim 1 where in said support brackets include means providing for tilting said seat member on a generally horizontal axis extending through a center portion of said seat member.

4. Apparatus as defined in claim 1 wherein each of said support members and each of said seat carrier members is tubular and has a generally rectangular cross-sectional configuration.

5. Apparatus as defined in claim 1 and including means for removing said seat member from said brackets in response to lifting said seat member vertically from said brackets.

6. Apparatus as defined in claim 5 wherein each of said support brackets has a sloping upper surface and defines an opening extending downwardly from said surface, said seat member includes a pair of pins projecting downwardly into said openings, and said openings are substantially larger than said pins to provide for tilting of said pins and said seat member relative to said support brackets.

7. Apparatus as defined in claim 1 wherein said seat member comprises a toilet seat having opposite side members projecting laterally to said brackets.

8. Apparatus for raising and lowering a seat member to assist handicapped a person, comprising a frame including a base adapted to rest on a floor and having generally parallel leg members connected by a front cross member, a pair of elongated parallel spaced inclined support members projecting upwardly and forwardly from said base, a pair of seat carrier members mounted on corresponding said support members for linear movement, said seat member extending between said seat carrier members, means connecting said seat member to said seat carrier members and supporting said seat member for movement with said seat carrier members, a pair of generally vertical lift units spaced in front of the corresponding said inclined support members and connecting said base to the corresponding said seat carrier members, said lift units cooperate to move said seat carrier members and said seat member along said support members between an upper elevated position and a lower seating position, said means connecting said seat member include a pair of support brackets surrounding and clamping said seat carrier members, and means for adjusting said support brackets generally vertically on said seat carrier members for vertically adjusting said seat member at said lower seating position.

9. Apparatus as defined in claim 8 wherein each of said support members and each of said seat carrier members is tubular and has a generally rectangular cross-sectional configuration.

10. Apparatus for raising and lowering a seat member to assist a handicapped person, comprising a frame including a base adapted to rest on a floor and having generally parallel leg members connected by a front cross member, a pair of elongated parallel spaced inclined support members projecting upwardly and forwardly from said base, a pair of seat carrier members mounted on corresponding said support members for linear movement, said seat member extending between said seat carrier members, means connecting said seat member to said seat carrier members and supporting said seat member for movement with said seat carrier members, a pair of generally vertical lift units spaced in front of the corresponding said inclined support members and connecting said base to the corresponding said seat carrier members, said lift units cooperate to move said seat carrier members and said seat member along said support members between an upper elevated position and a lower seating position, said means connecting said seat member including a pair of support brackets mounted on said seat carrier members, and means for removing said seat member from said brackets in response to lifting said seat member vertically from said brackets.

11. Apparatus as defined in claim 10 wherein each of said support brackets has a sloping upper surface and defines an opening extending downwardly from said surface, said seat member includes a pair of pins projecting downwardly into said openings, and said openings are substantially larger than said pins to provide for tilting of said pins and said seat member relative to said support brackets.

12. Apparatus for raising and lowering a seat member to assist a handicapped person, comprising a frame including a base adapted to rest on a floor and having generally parallel leg members connected by a front cross member, a pair of elongated parallel spaced inclined support members projecting upwardly and forwardly from said base, a pair of seat carrier members mounted on corresponding said support members for linear movement, said seat member extending between said seat carrier members, means connecting said seat member to said seat carrier members and supporting said seat member for movement with said seat carrier members, a pair of generally vertical lift units spaced in front of the corresponding said inclined support members and connecting said base to the corresponding said seat carrier members, said lift units cooperate to move said seat carrier members and said seat member along said support members between an upper elevated position and a lower seating position, and said seat member including a toilet seat having opposite side panels projecting laterally to said seat carrier members.

13. Apparatus as defined in claim 12 where in said means connecting said seat member comprise a pair of support brackets mounted on said seat carrier members, and said support brackets have sloping upper surfaces providing for tilting said seat member on a generally horizontal axis extending through a center portion of said seat member.

14. Apparatus as defined in claim 12 wherein support members project forwardly at an angle of about ten degrees from a vertical plane, and said means mounted on said seat carrier members and supporting said seat member comprise a pair of support brackets having upper surfaces disposed at an angle from a vertical plane.

* * * * *